US008967269B2

(12) United States Patent
Xu

(10) Patent No.: US 8,967,269 B2
(45) Date of Patent: Mar. 3, 2015

(54) TUBULAR VALVING SYSTEM AND METHOD

(75) Inventor: Richard YingQing Xu, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 855 days.

(21) Appl. No.: 13/186,799

(22) Filed: Jul. 20, 2011

(65) Prior Publication Data

US 2013/0020089 A1 Jan. 24, 2013

(51) Int. Cl.

| | |
|---|---|
| ***E21B 34/00*** | (2006.01) |
| ***E21B 34/06*** | (2006.01) |
| ***F16K 17/00*** | (2006.01) |
| ***F16K 1/16*** | (2006.01) |
| ***E21B 34/10*** | (2006.01) |

(52) U.S. Cl.

CPC ..... *E21B 34/102* (2013.01); *E21B 2034/005* (2013.01)

USPC ..... 166/334.1; 166/373; 137/527; 251/298

(58) Field of Classification Search

CPC ..... E21B 34/14; E21B 2034/005; E21B 2034/007; E21B 34/102; F16K 15/03

USPC ..... 166/332.8, 373, 324, 334.1; 137/527.2, 137/526.6, 527; 251/298

See application file for complete search history.

(56) References Cited

U.S. PATENT DOCUMENTS

| | | | | |
|---|---|---|---|---|
| 3,794,112 | A | 2/1974 | Hill | |
| 6,732,803 | B2 * | 5/2004 | Garcia et al. | 166/373 |
| 6,983,795 | B2 | 1/2006 | Zuklic et al. | |
| 7,762,336 | B2 * | 7/2010 | Johnson et al. | 166/332.7 |
| 7,779,919 | B2 * | 8/2010 | Goughnour et al. | 166/373 |
| 8,607,811 | B2 * | 12/2013 | Korkmaz | 137/68.11 |
| 2006/0113081 | A1 * | 6/2006 | Dennistoun et al. | 166/321 |
| 2012/0037373 | A1 * | 2/2012 | Xu | 166/308.1 |

OTHER PUBLICATIONS

A. Ehtesham et al., "Downhole Safety Valve for Well-Intervention Operations: Design, Testing, and Successful Case History"; Society of Petroleum Engineers International, SPE Paper No. 142887; Apr. 5, 2011; pp. 1-10.

Alvaro Viela et al., "Differential Pressure Valve Incorporated With the Single-Trip Horizontal Gravel Pack and Selective Stimulation System Improves Sand control for Extended Reach Wells"; Society of Petroleum Engineers, SPE Paper No. 86513, Feb. 18, 2004; pp. 1-9.

* cited by examiner

*Primary Examiner* — Kenneth L Thompson
*Assistant Examiner* — Michael Wills, III
(74) *Attorney, Agent, or Firm* — Cantor Colburn LLP

(57) ABSTRACT

A tubular valving system includes, a tubular, a seat, a sleeve movably engaged with the seat between at least a first position, a second position and a third position, a release member between the sleeve and the seat that maintains the sleeve relative to the seat in the first position until release thereof, a biasing member configured to urge the sleeve from the second position toward the third position, and a flapper sealingly engagable with the seat. A first threshold pressure against the seated flapper causes release of the release member allowing the sleeve and the seat to attain the second position. A subsequently drop in pressure against the seated flapper below a second threshold level allows the biasing member to move the sleeve relative to the seat to the third position thereby unseating the flapper from the seat and preventing the flapper from again seating with the seat.

18 Claims, 2 Drawing Sheets

TUBULAR VALVING SYSTEM AND METHOD

BACKGROUND

Tubular systems often employ valves that allow fluid to flow through a tubular or to block fluid flow through the tubular. After closing a valve to block flow it is sometimes desirable to reopen the valve to reestablish flow therethrough. Doing so can be difficult in systems wherein the blockage is via a plug run within the tubular to a seat. Removal of the plug to reopen the tubular may require reversing flow to pump the plug back out through the pathway that it entered. Other options include milling or machining the plug out. Many methods, including the two foregoing require time (during reverse flow or running of a milling tool) to remove the blockage. This time could be spent more productively. Tubular valving systems and methods that overcome these drawbacks are well received in the art.

BRIEF DESCRIPTION

Disclosed herein is a tubular valving system. The system includes a tubular, a seat movably engaged with the tubular, a sleeve movably engaged with the seat between at least a first position, a second position and a third position, a release member in operable communication with the sleeve and the seat that maintains the sleeve relative to the seat in the first position until release thereof, a biasing member configured to urge the sleeve from the second position toward the third position, and a flapper sealingly engagable with the seat. Pressure greater than a first threshold level against the flapper when seated causes release of the release member allowing the sleeve and the seat to attain the second position. Subsequently, a drop in pressure against the seated flapper below a second threshold level allows the biasing member to move the sleeve relative to the seat to the third position thereby unseating the flapper from the seat and preventing the flapper from again seating with the seat.

Further disclosed herein is a method of actuating valves in a tubular system. The method includes, pressuring up against a flapper seated with a seat within a tubular to pressure greater than a first threshold pressure, releasing a release member fixedly attaching the seat to a sleeve, decreasing pressure below a second threshold pressure and moving the sleeve relative to the seat thereby opening the flapper.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
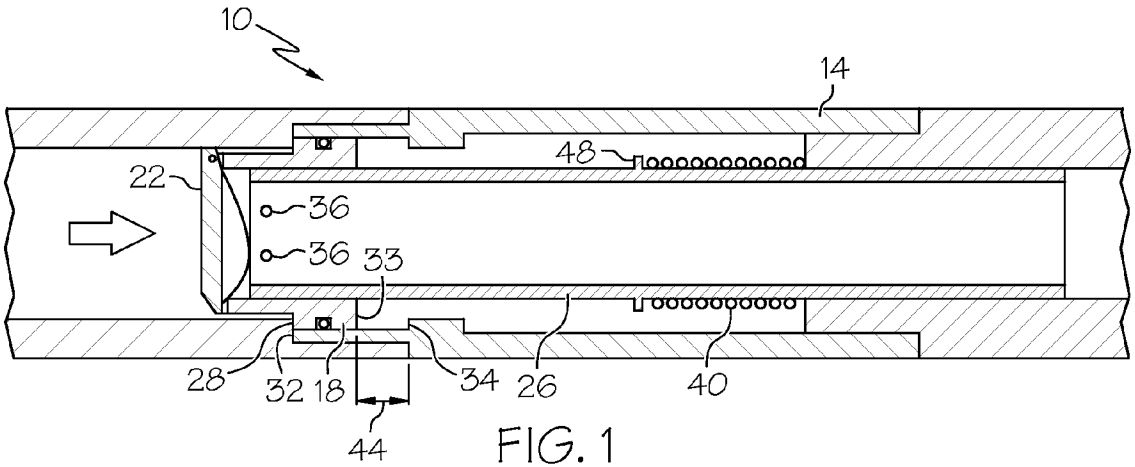
FIG. 1 depicts a cross sectional view of a tubular valving system disclosed herein illustrated in a closed position.
Figure 2:
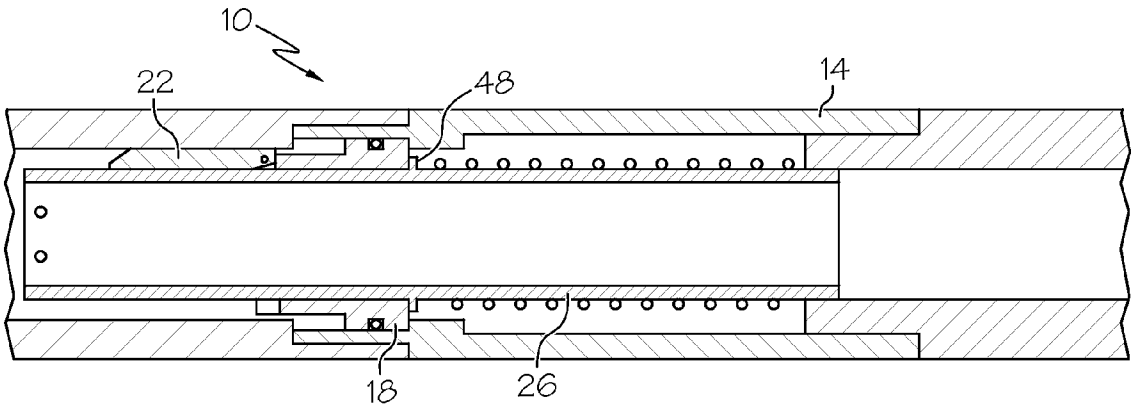
FIG. 2 depicts a cross sectional view of the tubular valving system of FIG. 1 illustrated in an open position.

Referring to FIGS. 1 and 2, an embodiment of a tubular valving system disclosed herein is illustrated at 10. The valving system 10 includes, a tubular 14, a seat 18, a flapper 22 and a sleeve 26. The seat 18 is movable relative to the sleeve 26 between at least a first position (shown in FIG. 1), a second position (not shown) and a third position (shown in FIG. 2). Initially a shoulder 28 of the seat 18 contacts a shoulder 32 of the tubular 14. One or more release members 36, shown herein as a plurality of shear screws; maintain the sleeve 26 relative to the seat 18 in the first position. Upon release of the release members 36, the seat 18 is moved relative to the sleeve 26, and the tubular 14, until another shoulder 33 on the seat 18 contacts another shoulder 34 on the tubular 14. A biasing member 40, illustrated as a compression spring, biases the sleeve 26 relative to the seat 18 in an axial direction in the Figures. This biasing member 40 urges the sleeve 26 against the flapper 22 thereby defining the second position. The biasing member 40 having insufficient force to urge the flapper 22 open until pressure against the seated flapper 22 drops below a threshold pressure (as discussed further below) maintains the system 10 in the second position. It should be noted that urging of the biasing members 40 causes the shoulders 32 and 28 to be in contact prior to pressure against the flapper 22 causes a gap to form between the shoulders 32 and 28 and release of the release members 36.

The foregoing structure allows pressure within the tubular 14, upstream of the flapper 22 when seated on the seat 18 (leftward in the Figures), to increase thereby generating a force on the seat 18 relative to the sleeve 26. The release members 36 support this force until a threshold pressure causes them to release. After release the seat 18 is moved by a dimension 44 relative to the tubular 14. It should be noted that in both the first position and the second position the flapper 22 is seated against the seat 18 and thus pressure upstream thereof can be employed to do work such as actuating an actuator, or fracturing or treating a formation, for example, in a case where the invention is employed in a downhole hydrocarbon recovery system, for example. It should be further noted that pressure subsequent release of the release member 36 could be increased to pressures greater than the first threshold pressure.

A subsequent reduction in pressure below another threshold pressure allows the biasing member 40 to move the sleeve 26 and the seat 18 until the shoulder 28 again contacts the shoulder 32 thereby stopping the seat 18 from moving further. Continued movement of the sleeve 26 relative to the seat 18 causes the system 10 to move from the second position to the third position. As the sleeve 26 moves it causes the flapper 22 to pivotally open relative to the seat 18. A shoulder 48 on the sleeve 26, in this embodiment, contacts the shoulder 33 on the seat 18 to limit travel therebetween. The sleeve 26 holds the flapper 22 open and defines the third position.

Any practical number of the tubular valving systems 10 can be employed within the tubular 14. Actuation of each of the systems 10 along the tubular 14 would then be actuatable, with nothing more than changes in pressure, in sequence starting with the most upstream one and moving downward toward the most downstream one of the systems 10. Actuation as used herein means; pressuring up against the flapper 22, releasing the release members 36, pressuring up if desired to another pressure, and finally reducing pressure and allowing the sleeve 26 to move to the third position.

Figure 3:
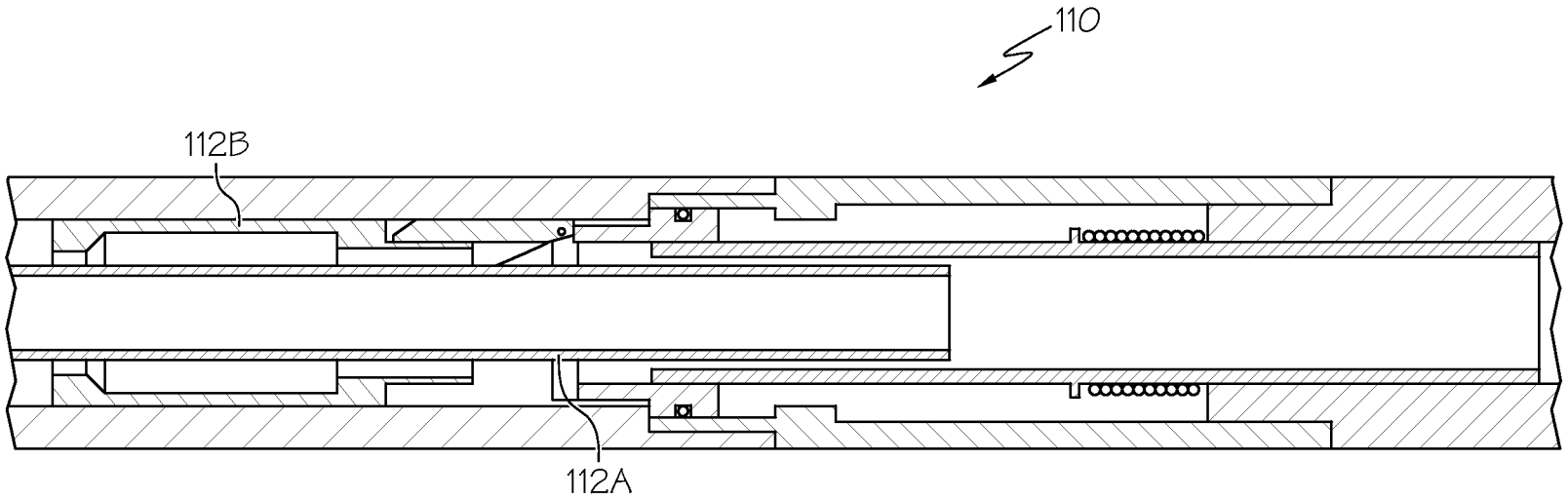
FIG. 3 depicts a cross sectional view of an alternate tubular valving system disclosed herein illustrated in an open position.

Referring to FIG. 3, an alternate embodiment of a tubular valving system is illustrated at 110. The system 110 varies from that of system 10 by the addition of one or more hold-open elements 112A, 112B. The hold-open element 112A can be in the form of a single elongated component, such as a coiled tubing or wireline, for example, an assembly of components, or alternately can be a plurality of separate hold-open elements 112B, such as a collar as illustrated, with one being in operable communication with each of the flappers 22. Regardless of the configuration of the hold-open element 112A, 112B the function is the same, to hold the flapper 22 open until the hold-open element 112A, 112B is moved to a location wherein it no longer holds the flapper 22 open.

The system 110 therefore allows for an altered operational sequencing relative to that of the system 10. By employing a plurality of the systems 110 along the tubular 14, for example, the sequence can be such that all the flappers 22 are initially open and then are made to actuate one at a time in order from the furthest downstream first to the furthest upstream last. Actuation of the systems 110 means moving the hold-open element 112A, 112B, closing the flapper 22, pressuring up against the flapper 22, releasing the release members 36, pressuring up if desired to another pressure, and finally reducing pressure and allowing the sleeve 26 to move to the third position While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A tubular valving system comprising:

a tubular;

a seat movably engaged with the tubular;

a sleeve movably engaged with the seat between at least a first position, a second position and a third position;

a release member in operable communication with the sleeve and the seat that maintains the sleeve relative to the seat in the first position until release thereof;

a biasing member configured to urge the sleeve from the second position toward the third position; and a flapper sealingly engagable with the seat, such that pressure greater than a first threshold level against the flapper when seated causes release of the release member allowing the sleeve and the seat to attain the second position and a drop in pressure against the seated flapper below a second threshold level allows the biasing member to move the sleeve relative to the seat to the third position thereby unseating the flapper from the seat and preventing the flapper from being seatable with the seat.

2. The tubular valving system of claim 1, further comprising a plurality of the seats disposed at the tubular with each of the plurality of seats being in operable communication with one of a plurality of the sleeves, one of a plurality of the release members, one of a plurality of the biasing members and one of a plurality of the flappers such that each of the plurality of flappers is openable sequentially in a downstream direction.

3. The tubular valving system of claim 1, further comprising a hold-open element in operable communication with the flapper and movable between at least a first location that prevents the flapper from seating with the seat and a second location that permits the flapper to seat with the seat.

4. The tubular valving system of claim 3, further comprising a plurality of the seats disposed at the tubular with each of the plurality of seats being in operable communication with one of a plurality of the sleeves, one of a plurality of the release members, one of a plurality of the biasing members, one of a plurality of the flappers and at least one of the hold-open elements, the at least one of the hold-open elements being selectively movable between the first location and the second location.

5. The tubular valving system of claim 4, wherein the at least one of the hold-open elements is sequentially movable from the first location to the second location in an upstream direction.

6. The tubular valving system of claim 4, wherein the at least one of the hold-open elements is one continuous element that is engagable with all of the plurality of flappers.

7. The tubular valving system of claim 4, wherein the at least one of the hold-open elements is a plurality of the hold-open elements with a separate one of the hold-open elements being in operable communication with each of the flappers.

8. The tubular valving system of claim 7, wherein the plurality of hold-open elements are collars.

9. The tubular valving system of claim 1, wherein the flapper continues to be seated when the seat and the sleeve are in the second position.

10. A method of actuating valves in a tubular system comprising:

pressuring up against a flapper seated with a seat within a tubular to pressure greater than a first threshold pressure;

releasing a release member fixedly attaching the seat to a sleeve;

decreasing pressure below a second threshold pressure; and moving the sleeve relative to the seat thereby opening the flapper.

11. The method of actuating valves in a tubular system of claim 10, further comprising moving the seat relative to the sleeve subsequent release of the release member.

12. The method of actuating valves in a tubular system of claim 10, wherein the moving the sleeve relative to the seat subsequent decreasing pressure is via a biasing member urging the sleeve relative to the seat.

13. The method of actuating valves in a tubular system of claim 10, further comprising pressuring up subsequent to release of the release member.

14. The method of actuating valves in a tubular system of claim 10, further comprising doing work with the pressuring up at pressures below or above the first threshold pressure prior to decreasing pressure below a second threshold pressure.

15. The method of actuating valves in a tubular system of claim 10, further comprising holding the flapper open with the sleeve subsequent decreasing the pressure.

16. The method of actuating valves in a tubular system of claim 10, further comprising:

pressuring up against a second flapper seated with a second seat within the tubular to pressure greater than a third threshold pressure;

releasing a second release member fixedly attaching the second seat to a second sleeve;

decreasing pressure below a fourth threshold pressure; and moving the second sleeve relative to the second seat thereby opening the second flapper.

17. The method of actuating valves in a tubular system of claim 10, further comprising:

moving a hold-open element relative to the flapper; and closing the flapper prior to pressuring up against the flapper.

18. The method of actuating valves in a tubular system of claim 17, further comprising:

moving a second hold-open element relative to a second flapper;

closing the second flapper;

pressuring up against the second flapper seated with a second seat within the tubular to pressure greater than a third threshold pressure;

releasing a second release member fixedly attaching the second seat to a second sleeve;

decreasing pressure below a fourth threshold pressure; and moving the second sleeve relative to the second seat thereby opening the second flapper.

* * * * *